US010329747B2

(12) United States Patent
Lu et al.

(10) Patent No.: US 10,329,747 B2
(45) Date of Patent: Jun. 25, 2019

(54) FAUCET MOUNTING MECHANISM

(71) Applicant: Xiamen Easo Co., Ltd., Xiamen, Fujian (CN)

(72) Inventors: Haitao Lu, Xiamen (CN); Zhen Li, Xiamen (CN); Ximin Chen, Xiamen (CN)

(73) Assignee: XIAMEN EASO CO., LTD., Xiamen, Fujian (CN)

( * ) Notice: Subject to any disclaimer, the term of this patent is extended or adjusted under 35 U.S.C. 154(b) by 0 days.

(21) Appl. No.: 15/817,262

(22) Filed: Nov. 19, 2017

(65) Prior Publication Data

US 2019/0153706 A1 May 23, 2019

(51) Int. Cl.
*E03C 1/04* (2006.01)

(52) U.S. Cl.
CPC ..... *E03C 1/0401* (2013.01)

(58) Field of Classification Search
CPC ..... E03C 1/0401
USPC ..... 4/678, 695
See application file for complete search history.

(56) References Cited

U.S. PATENT DOCUMENTS 4,281,857 A * 8/1981 Randall ..... E03C 1/0401 24/498
6,631,730 B1 * 10/2003 Bloom ..... E03C 1/0401 137/359
6,725,472 B2 * 4/2004 Gray ..... E03C 1/0401 137/606
6,807,692 B2 * 10/2004 Tsutsui ..... E03C 1/0401 137/359
7,296,588 B1 * 11/2007 Hwang ..... E03C 1/0401 137/359

* cited by examiner

*Primary Examiner* — Christine J Skubinna
(74) *Attorney, Agent, or Firm* — Chun-Ming Shih

(57) ABSTRACT

A faucet mounting mechanism includes a faucet body, a mounting countertop, and a fastening device. The fastening device includes a fixing seat, a linkage mechanism, a return mechanism, and a bolt. Through the cooperation of the fixing seat, the bolt, the return mechanism and the linkage mechanism having four connecting rods, the faucet mounting mechanism is achieved for mounting and dismounting a faucet on the counting countertop quickly.

10 Claims, 12 Drawing Sheets

FAUCET MOUNTING MECHANISM

BACKGROUND OF THE INVENTION

1. Field of the Invention

The present invention relates to a faucet mounting mechanism, and more particularly to a faucet mounting mechanism for mounting and dismounting a faucet on a mounting countertop quickly.

2. Description of the Prior Art

A kitchen faucet or a basin faucet is installed at a position close to the wall. Due to the shape of the kitchen stainless steel sink and the basin body, the space under the countertop for locking the faucet is limited. According to the traditional operation to lock the nut on the bolt, the nut is rotated from the lower end of the bolt. The effective length of the bolt depends on the thickness of the countertop, which determines the length of the nut to be locked. Thus, to lock or unlock the nut takes time and energy. It is not easy to install the faucet.

Accordingly, the inventor of the present invention has devoted himself based on his many years of practical experiences to solve these problems.

SUMMARY OF THE INVENTION

The primary object of the present invention is to provide a faucet mounting mechanism for mounting a faucet on a countertop quickly.

In order to achieve the aforesaid object, the faucet mounting mechanism of the present invention comprises a faucet body and a fastening device. The fastening device includes a fixing seat, a linkage mechanism, a return mechanism, and at least one bolt. The fixing seat has a mounting passage through which a pipe passes. An upper end of the fixing seat is mated with the faucet body. A lower end of the fixing seat is provided with a limit mechanism for restricting rotation of the linkage mechanism. The linkage mechanism includes an upper connecting member, a lower connecting member, and a plurality of connecting rods linked by the upper connecting member and the lower connecting member. The upper connecting member has a through hole to slidably mate with the bolt. The lower connecting member has a screw hole screwed with the bolt. The return mechanism is disposed on the linkage mechanism and has an elastic force to extend the upper connecting member and the lower connecting member. By rotating the bolt on a mounting countertop, the linkage mechanism is tightly attached to a bottom of the mounting countertop under the action of the upper connecting member, the lower connecting member and the limit mechanism.

Preferably, the fixing seat is provided with a fixing plate at one side of the mounting passage. The fixing plate has a perforation through which the bolt passes. The limit mechanism is disposed at a bottom of the fixing plate.

Preferably, the plurality of connecting rods include a first connecting rod, a second connecting rod, a third connecting rod, and a fourth connecting rod. The first connecting rod and the second connecting rod are pivotally connected to two ends of the upper connecting member or the lower connecting member. First ends of the third connecting rod and the fourth connecting rods are pivotally connected to free ends of the first connecting rod and the second connecting rod, respectively. Second ends of the third connecting rod and the fourth connecting rod are pivotally connected to the two ends of the upper connecting member or the lower connecting member.

Preferably, the return mechanism is a return spring. The return spring is disposed between the through hole of the upper connecting member and the screw hole of the lower connecting member.

Preferably, the return mechanism is two torsion springs. The two torsion springs are disposed at the junction of the first connecting rod and the third connecting rod as well as the junction of the second connecting rod and the fourth connecting rod, respectively. Two arms of each torsion spring correspond to and hold against the first connecting rod and the third connecting rod as well as the second connecting rod and the fourth connecting rod. Adjacent ends of the first connecting rod and the third connecting rod as well as the second connecting rod and the fourth connecting rod are respectively formed with grooves for accommodating the arms of the torsion springs.

Preferably, a bottom end of the bolt is provided with a nut for preventing the linkage mechanism from disengaging from the bolt.

Preferably, one of the upper connecting member and the linkage mechanism has a skidproof portion. A gasket is provided at bottom surfaces of the fixing seat and the mounting hole of the mounting countertop.

Preferably, the junction of the first connecting rod and the third connecting rod as well as the junction of the second connecting rod and the fourth connecting rod is provided with a directional joint.

Preferably, an outer side of the faucet body has a receiving hole. The receiving hole is mated with a fastening screw. An outer periphery of a top end of the fixing seat of the fastening device is provided with a flange for engagement of the fastening screw.

Preferably, the fixing seat includes a limit mounting ring to mate with the mounting hole of the mounting countertop. The limit mounting ring is eccentrically disposed relative to the fixing seat.

Accordingly, the present invention comprises the fixing seat, the bolt, the return mechanism and the linkage mechanism to realize the faucet mounting mechanism for mounting and dismounting the faucet body on the mounting countertop quickly. When installed, the fastening device is inserted from the mounting hole of the mounting countertop to the bottom of the mounting countertop. By tightening the bolt on the mounting countertop, the linkage mechanism is driven to move upward, thereby fastening the linkage mechanism and the mounting countertop. When the bolt is loosened on the mounting countertop, the return mechanism pushes the linkage mechanism downward so that the linkage mechanism is disengaged from the mounting hole of the mounting countertop. The present invention solves the problem of the prior art.

DETAILED DESCRIPTION OF THE PREFERRED EMBODIMENTS

Figure 1:
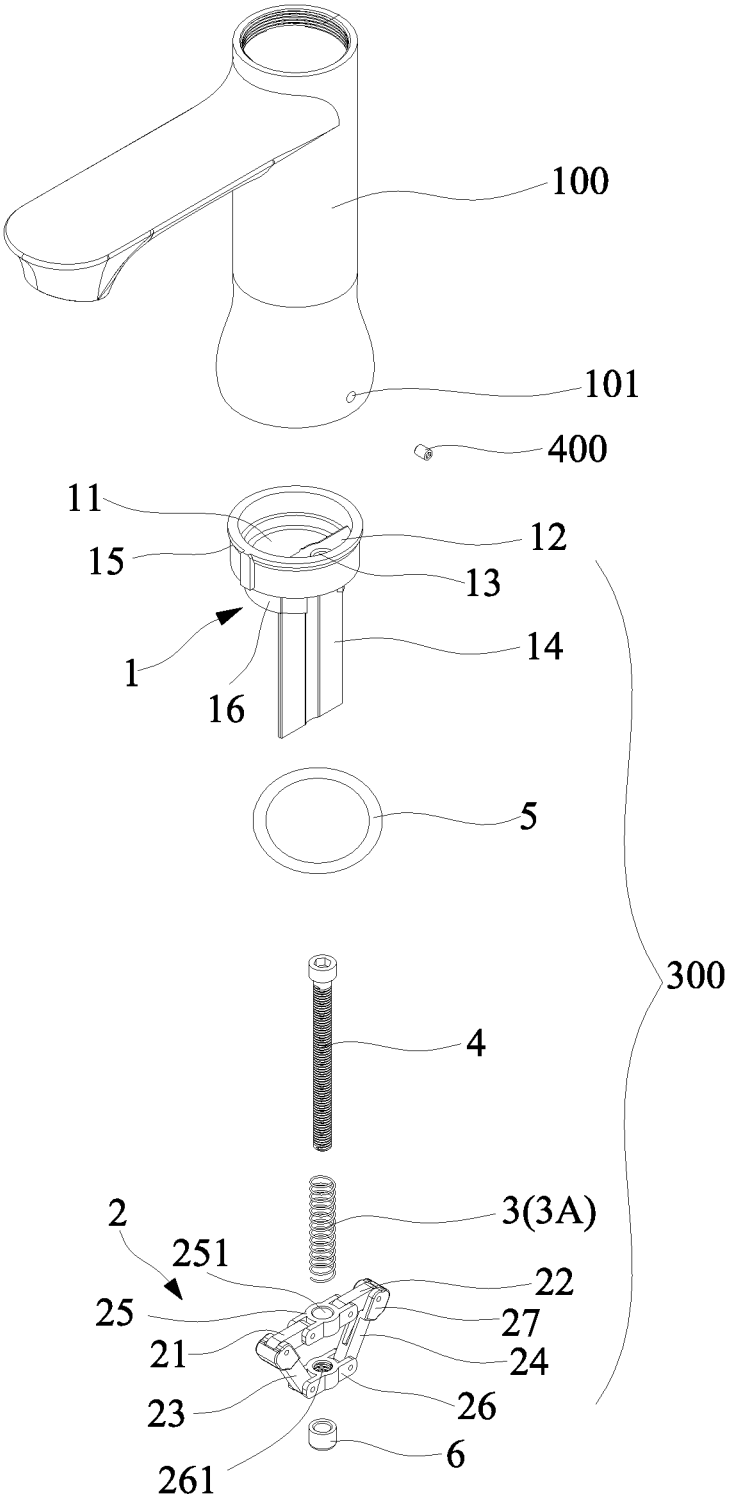
FIG. 1 is an exploded view in accordance with a first embodiment of the present invention.
Figure 2:
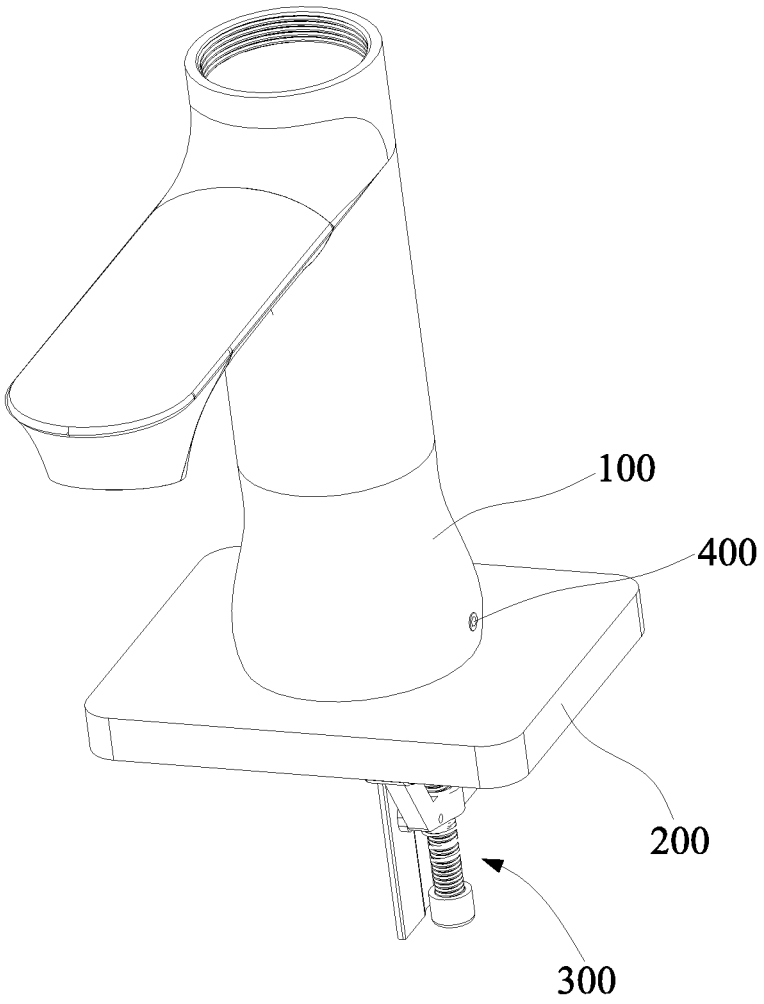
FIG. 2 is a perspective view in accordance with the first embodiment of the present invention.
Figure 3:
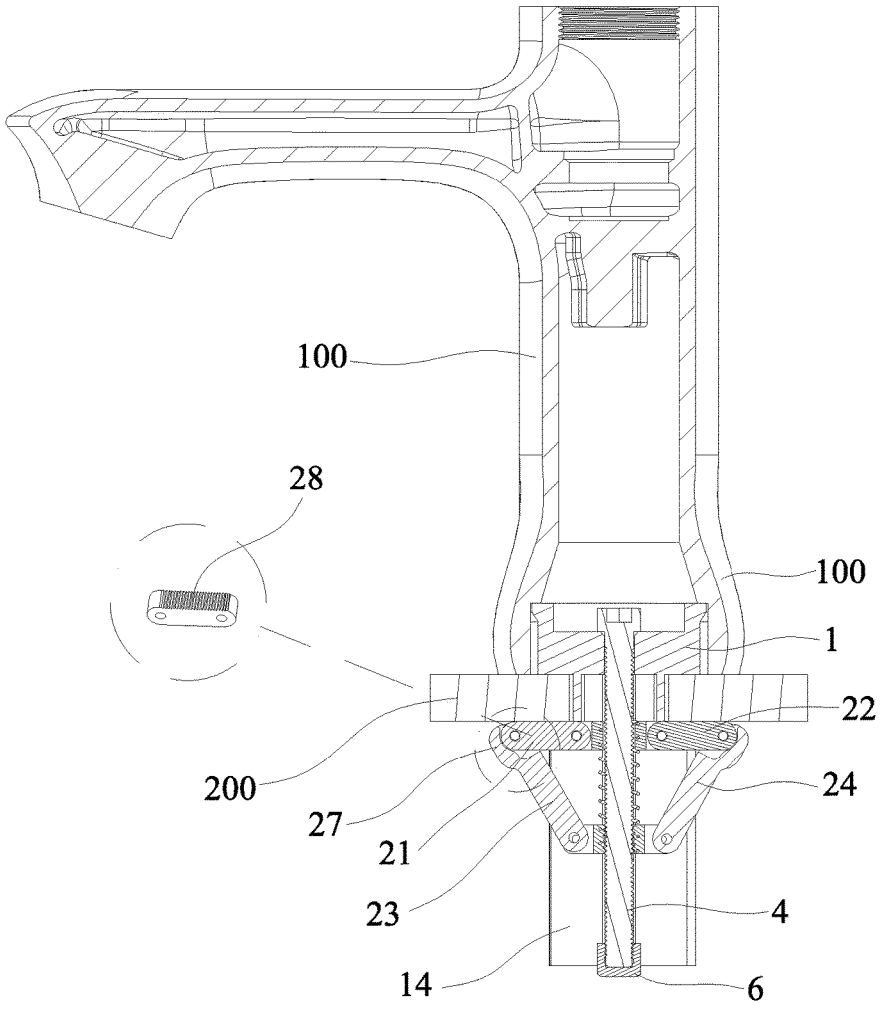
FIG. 3 is a sectional view in accordance with the first embodiment of the present invention.

Embodiments of the present invention will now be described, by way of example only, with reference to the accompanying drawings.

Referring to FIG. 1 to FIG. 12, the present invention discloses a faucet mounting mechanism. The faucet mounting mechanism comprises a faucet body 100, a mounting countertop 200, and a fastening device 300.

An outer side of a lower end of the faucet body 100 has a receiving hole 101. The receiving hole 101 is mated with a fastening screw 400.

The mounting countertop 200 has a mounting hole 201.

The fastening device 300 includes a fixing seat 1, a linkage mechanism 2, a return mechanism 3, and a bolt 4.

Figure 4:
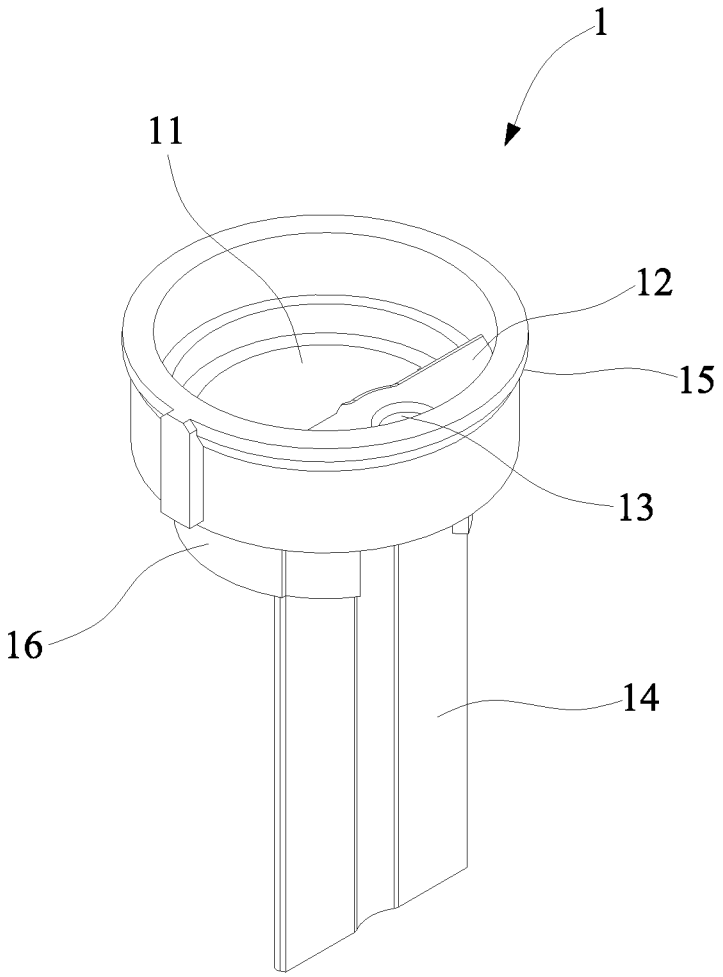
FIG. 4 is a perspective view of the fixing seat in accordance with the first embodiment of the present invention.

FIG. 1 to FIG. 7 shows a first preferred embodiment of the present invention. In this embodiment, the return mechanism 3 is a return spring 3A. As shown in FIG. 4, the fixing seat 1 is fitted to the mounting hole 201 of the mounting countertop 200. The fixing seat 1 has a mounting passage 11 through which a pipe passes. One side of the mounting passage 11 is provided with a fixing plate 12. The fixing plate 12 has a perforation 13 through which the bolt 4 passes. The fixing seat 1 is provided with a limit mechanism fixed to the bottom of the fixing plate 12 for restricting the rotation of the linkage mechanism 2. In this embodiment, as shown in the drawings, the limit mechanism is a baffle 14, which may be a rib or other structure. The faucet body 100 is mated with the fixing seat 1. An outer periphery of a top end of the fixing seat 1 is provided with a flange 15 for engagement of the fastening screw 400. The fastening screw 400 is inserted into the receiving hole 101 of the faucet body 100 and extend to the bottom surface of the flange 15 of the fixing seat 1, so that the faucet body 100 and the fixing seat 1 are connected together. The fixing seat 1 may be provided with a limit portion to limit the rotation of the faucet body 100. A gasket 5 is provided at the bottom surfaces of the fixing seat 1 and the mounting hole 201 of the mounting countertop 200. The fixing seat 1 includes a limit mounting ring 16 to mate with the mounting hole 201 of the mounting countertop 200. The limit mounting ring 16 is eccentrically disposed relative to the fixing seat 1, so that the fixing seat 1 is mated with the mounting hole 201 of the mounting countertop 200 and won't be rotated.

Figure 5:
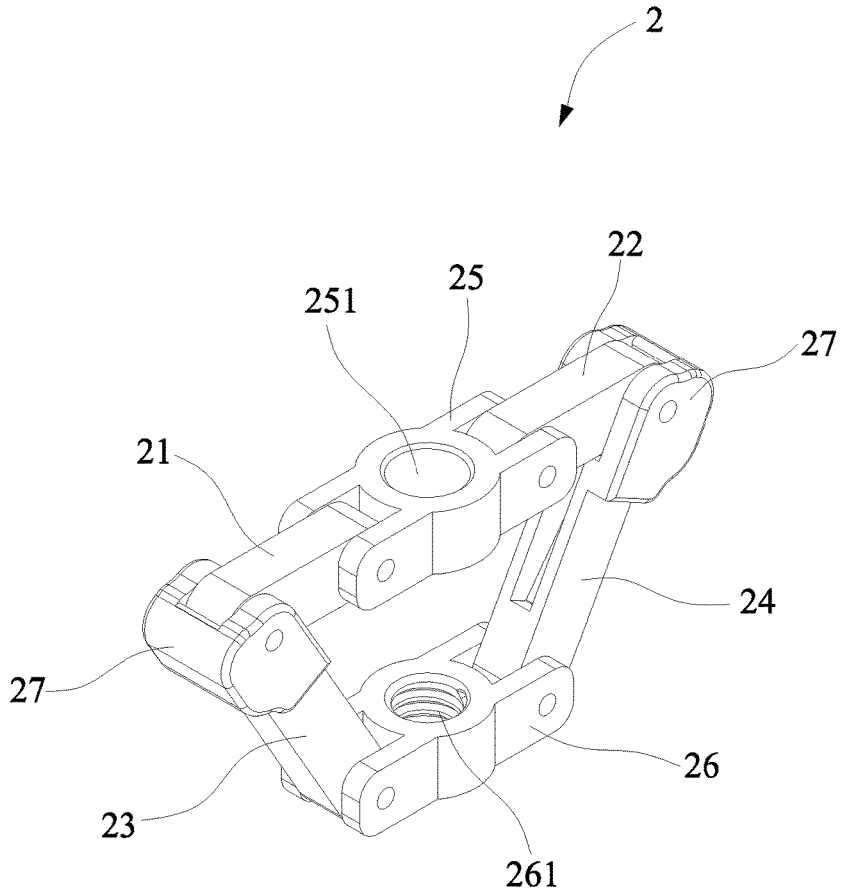
FIG. 5 is a perspective view of the linkage mechanism in accordance with the first embodiment of the present invention.

As shown in FIG. 5, the linkage mechanism 2 includes a plurality of connecting rods. As shown in the drawings, this embodiment illustrates four connecting rods as an example, a first connecting rod 21, a second connecting rod 22, a third connecting rod 23, and a fourth connecting rod 24. The linkage mechanism 2 further includes an upper connecting member 25 having a through hole 251 and a lower connecting member 26 having a screw hole 261. The inner wall of the through hole 251 of the upper connecting member 25 is smooth, and the screw hole 261 of the lower connecting member 26 is mated with external threads of the bolt 4. The first connecting rod 21 and the second connecting rod 22 are pivotally connected to two ends of the upper connecting member 25 or the lower connecting member 26. As shown in the drawings, in this embodiment, the first connecting rod 21 and the second connecting rod 22 are pivotally connected to two ends of the upper connecting member 25, as an example. The first connecting rod 21 and the second connecting rod 22 may be pivotally connected to two ends of the lower connecting member 26. First ends of the third connecting rod 23 and the fourth connecting rods 24 are pivotally connected to free ends of the first connecting rod 21 and the second connecting rod 22, respectively. Second ends of the third connecting rod 23 and the fourth connecting rod 24 are pivotally connected to the two ends of the upper connecting member 25 or the two ends of the lower connecting member 26. In this embodiment, because the first connecting rod 21 and the second connecting rod 22 are pivotally connected to the two ends of the upper connecting member 25, the second ends of the third connecting rod 23 and the fourth connecting rod 24 are pivotally connected to the two ends of the lower connecting member 26 to form a four-section linkage mechanism. In order to prevent reversion, the junction of the first connecting rod 21 and the third connecting rod 23 as well as the junction of the second connecting rod 22 and the fourth connecting rod 24 is provided with a directional joint 27. After installed, the upper connecting member 25, the first connecting rod 21 and the second connecting rod 2 lean against the countertop 200. For the mounting countertop 200 to be more closely fitted with the linkage mechanism 2, at least one of the upper connecting member 25, the first connecting rod 21 and the second connecting rod 22 has a skidproof portion.

The return spring 3A is disposed between the upper connecting member 25 and the lower connecting member 26.

The bolt 4 is inserted through the perforation 13 of the fixing seat 31 and then mated with the through hole 251 of the upper connecting member 25, the return spring 3A, and the screw hole 261 of the lower connecting member 26. The bottom surface of the bolt 4 is provided with a nut 6 for preventing the linkage mechanism 2 from disengaging from the bolt 4. Through the arrangement of the nut 6, the linkage mechanism 2 won't disengage from the bolt 4 during operation to ensure a smooth installation process.

As shown in FIG. 1 to FIG. 5, when the fastening device 300 is assembled, the bottom end of the bolt 4 passes through the perforation 13 of the fixing seat 1, and the linkage mechanism 2 is placed at one side of the baffle 14, opposite to the mounting passage 11, and the bottom of the bolt 4 is successively inserted through the through hole 251 of the upper connecting member 25, the return spring 3A, and the screw hole 261 of the lower connecting member 26. The nut 6 is screwed to the bottom end of the bolt 4. By the action of the elasticity of the return spring 3A, the distance between the upper connecting member 25 and the lower connecting member 26 is maximized and the distance between the left and right connecting rods is minimized. In this state, the fastening device 300 can be mounted in or pulled out of the mounting hole 201 of the mounting countertop 200.

Figure 6:
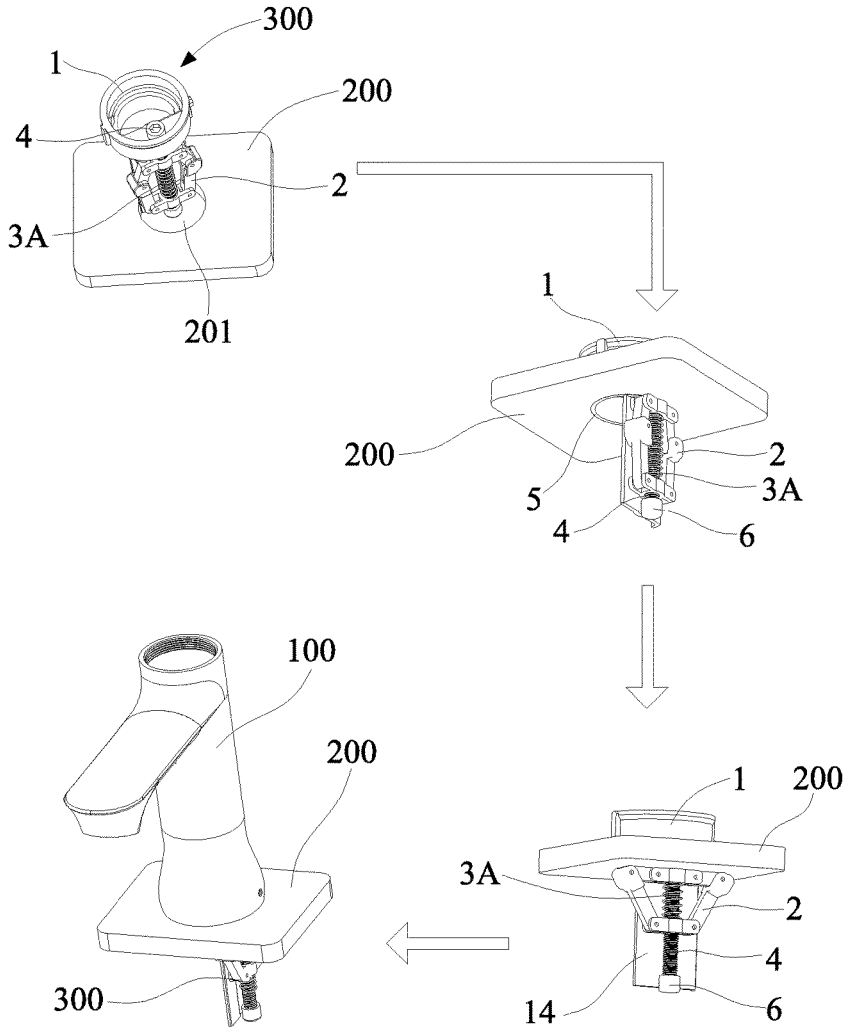
FIG. 6 is a flow chart showing the installation process of the first embodiment of the present invention.

As shown in FIG. 6, when the present invention is mounted, the linkage mechanism 2, disposed at the bottom of the fixing seat 1 and biased by the return spring 3A and located between the upper end of the bolt 4 and the nut 6, is inserted in the mounting hole 201 of the mounting countertop 200, and then the bolt 4 is screwed. Because the lower connecting member 26 of the linkage mechanism 2 is engaged with the threads with the bolt 4, the lower connecting member 26 is rotated while the bolt 4 is rotated. But, the linkage mechanism 2 is subjected to the baffle 14 of the fixing seat 1 and cannot be rotated. When the bolt 4 is tightened, the linkage mechanism 2 is driven to move upward, so that the upper connecting member 25 of the linkage mechanism 2 abuts against the bottom surface of the mounting countertop 200 and the lower connecting member 26 is moved upward with the rotation of the bolt 4 to compress the return spring 3A. During the process that the lower connecting member 26 is moved upward, the first connecting rod 21, the second connecting rod 22, the third connecting rod 23, and the fourth connecting rod 24 are linked to unfold outward, so that the entire linkage mechanism 2 is blocked at the bottom of the mounting hole 201 until the first connecting rod 21 and the second connecting rod 22 are against the bottom surface of the mounting countertop 200. The bolt 4 is locked, and the fastening device 300 is securely engaged with the mounting countertop 200. Finally, the faucet body 100 is fitted on the fixing seat 1 of the fastening device 300 and the fastening screw 400 is inserted in the receiving hole 101 of the faucet body 100 to mate with the flange 15 of the fixing seat 1, such that the faucet body 100, the mounting countertop 200 and the fastening device 300 are joined together.

Figure 7:
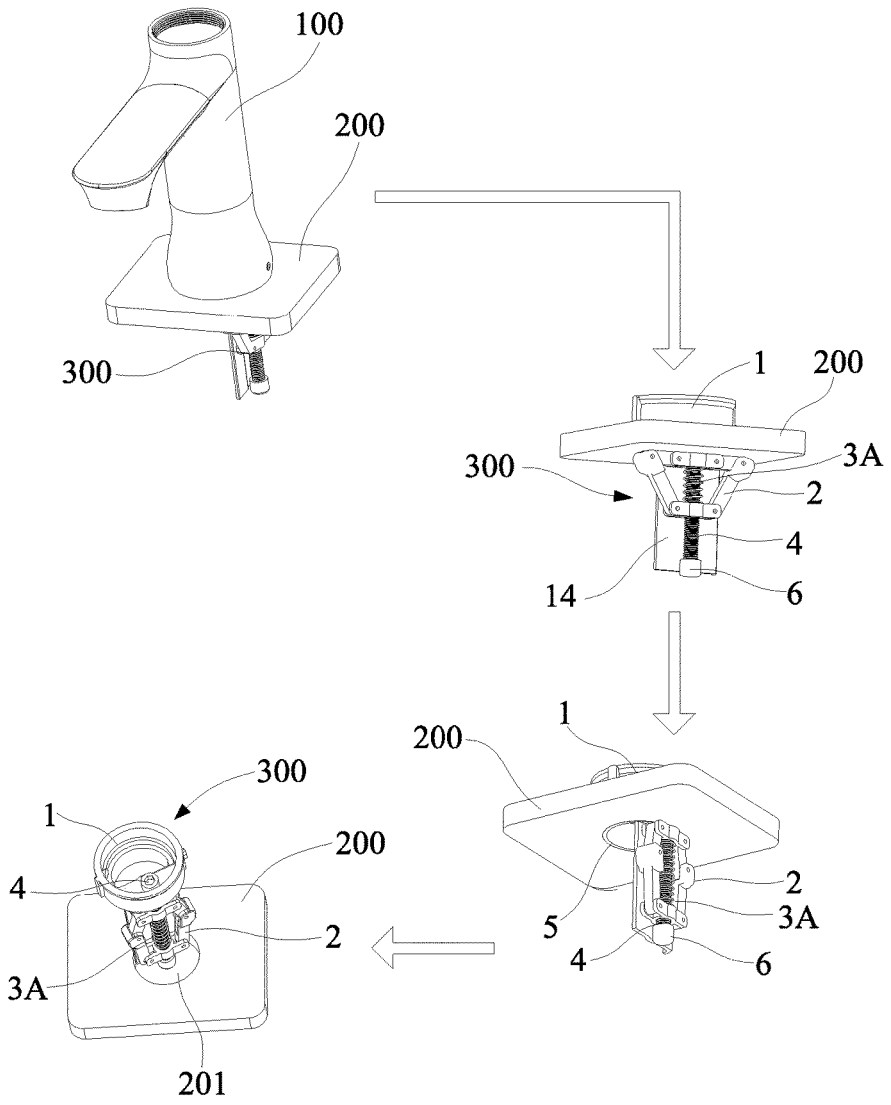
FIG. 7 is a flow chart showing the disassembly process of the first embodiment of the present invention.

As shown in FIG. 7, when the faucet is to be removed, the fastening screw 400 on the faucet body 100 is removed by a tool. The faucet body 100 is pulled out, the bolt 4 is loosened, and the bolt 4 drives the linkage mechanism 2 to move downward. The lower connecting member 26 is continuously moved toward the nut 6. The distance between the upper connecting member 25 and the lower connecting member 26 is increased by the action of the return spring 3A until the four connecting rods are extended to the maximum distance between the connecting member 25 and the lower connecting member 26. The lower connecting member 26 won't disengage from the bolt 4 due to the restriction of the nut 6. When the distance between the upper connecting member 25 and the lower connecting member 26 is the maximum, the lateral distance of the four connecting rods is minimized. The fastening device 300 can pass through the mounting hole 201 of the mounting countertop 200, so that the entire fastening device 300 can be pulled out from the mounting hole 201 to complete the disassembly.

FIG. 8 to FIG. 12 shows a second embodiment of the present invention. In the second embodiment, the return mechanism 3 includes two torsion springs 3B. In the second embodiment, the fixing seat 1 the linkage mechanism 2, and the bolt 4 are the same as the first embodiment. As shown in FIG. 4, the fixing seat 1 is fitted to the mounting hole 201 of the mounting countertop 200. The fixing seat 1 has a mounting passage 11 through which a pipe passes. One side of the mounting passage 11 is provided with a fixing plate 12. The fixing plate 12 has a perforation 13 through which the bolt 4 passes. The fixing seat 1 is provided with a baffle 14 fixed to the bottom of the fixing plate 12. The faucet body 100 is mated with the fixing seat 1. An outer periphery of a top end of the fixing seat 1 is provided with a flange 15 for engagement of the fastening screw 400. The fastening screw 400 is inserted into the receiving hole 101 of the faucet body 100 and extend to the bottom surface of the flange 15 of the fixing seat 1, so that the faucet body 100 and the fixing seat 1 are connected together. The fixing seat 1 may be provided with a limit portion to limit the rotation of the faucet body 100. A gasket 5 is provided at the bottom surfaces of the fixing seat 1 and the mounting hole 201 of the mounting countertop 200.

Figure 10:
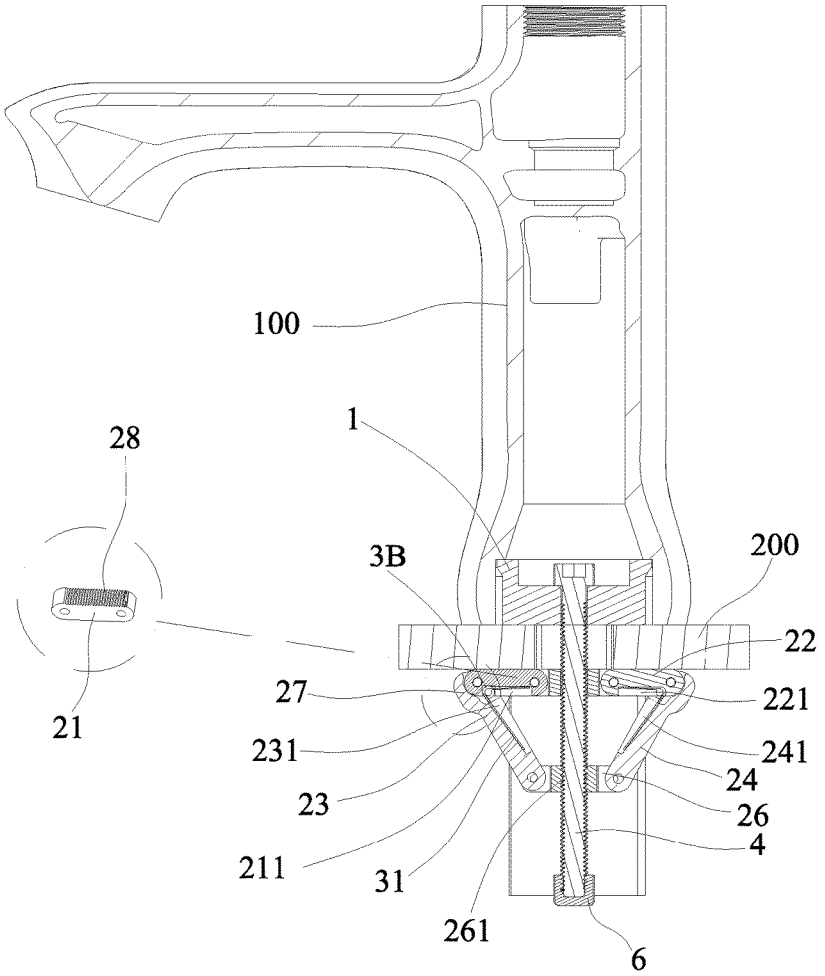
FIG. 10 is a sectional view in accordance with the second embodiment of the present invention.

As shown in FIG. 10 in cooperation with FIG. 5, the linkage mechanism 2 includes a first connecting rod 21, a second connecting rod 22, a third connecting rod 23, a fourth connecting rod 24, an upper connecting member 25 having a through hole 251, and a lower connecting member 26 having a screw hole 261. The inner wall of the through hole 251 of the upper connecting member 25 is smooth, and the screw hole 261 of the lower connecting member 26 is mated with external threads of the bolt 4. The first connecting rod 21 and the second connecting rod 22 are pivotally connected to two ends of the upper connecting member 25 or the lower connecting member 26. As shown in the drawings, in this embodiment, the first connecting rod 21 and the second connecting rod 22 are pivotally connected to two ends of the upper connecting member 25, as an example. The first connecting rod 21 and the second connecting rod 22 may be pivotally connected to two ends of the lower connecting member 26. First ends of the third connecting rod 23 and the fourth connecting rods 24 are pivotally connected to free ends of the first connecting rod 21 and the second connecting rod 22, respectively. Second ends of the third connecting rod 23 and the fourth connecting rod 24 are pivotally connected to the two ends of the upper connecting member 25 or the two ends of the lower connecting member 26. In this embodiment, the first connecting rod 21 and the second connecting rod 22 are pivotally connected to the two ends of the upper connecting member 25, so the second ends of the third connecting rod 23 and the fourth connecting rod 24 are pivotally connected to the two ends of the lower connecting member 26 to form a four-section linkage mechanism. In order to prevent reversion, the junction of the first connecting rod 21 and the third connecting rod 23 as well as the junction of the second connecting rod 22 and the fourth connecting rod 24 is provided with a directional joint 27. After installed, the upper connecting member 25, the first connecting rod 21 and the second connecting rod 2 lean against the countertop 200. For the mounting countertop 200 to be more closely fitted with the linkage mechanism 2, at least one of the upper connecting member 25, the first connecting rod 21 and the second connecting rod 22 has a skidproof portion.

The two torsion springs B are disposed at the junction of the first connecting rod 21 and the third connecting rod 23 and the junction of the second connecting rod 22 and the fourth connecting rod 24, respectively. Two arms 31 of each torsion spring 3B correspond to and hold against the first connecting rod 21 and the third connecting rod 23 as well as the second connecting rod 22 and the fourth connecting rod 24. Furthermore, the adjacent ends of the first connecting rod 21 and the third connecting rod 23 as well as the second connecting rod 22 and the fourth connecting rod 24 are respectively formed with grooves 211, 221, 231, 241 for accommodating the arms 31 of the torsion springs 3B.

The bolt 4 is inserted through the perforation 13 of the fixing seat 31 and then mated with the through hole 251 of the upper connecting member 25 and the screw hole 261 of the lower connecting member 26. The bottom surface of the bolt 4 is provided with a nut 6 for preventing the linkage mechanism 2 from disengaging from the bolt 4. Through the arrangement of the nut 6, the linkage mechanism 2 won't disengage from the bolt 4 during operation to ensure a smooth installation process.

Figure 8:
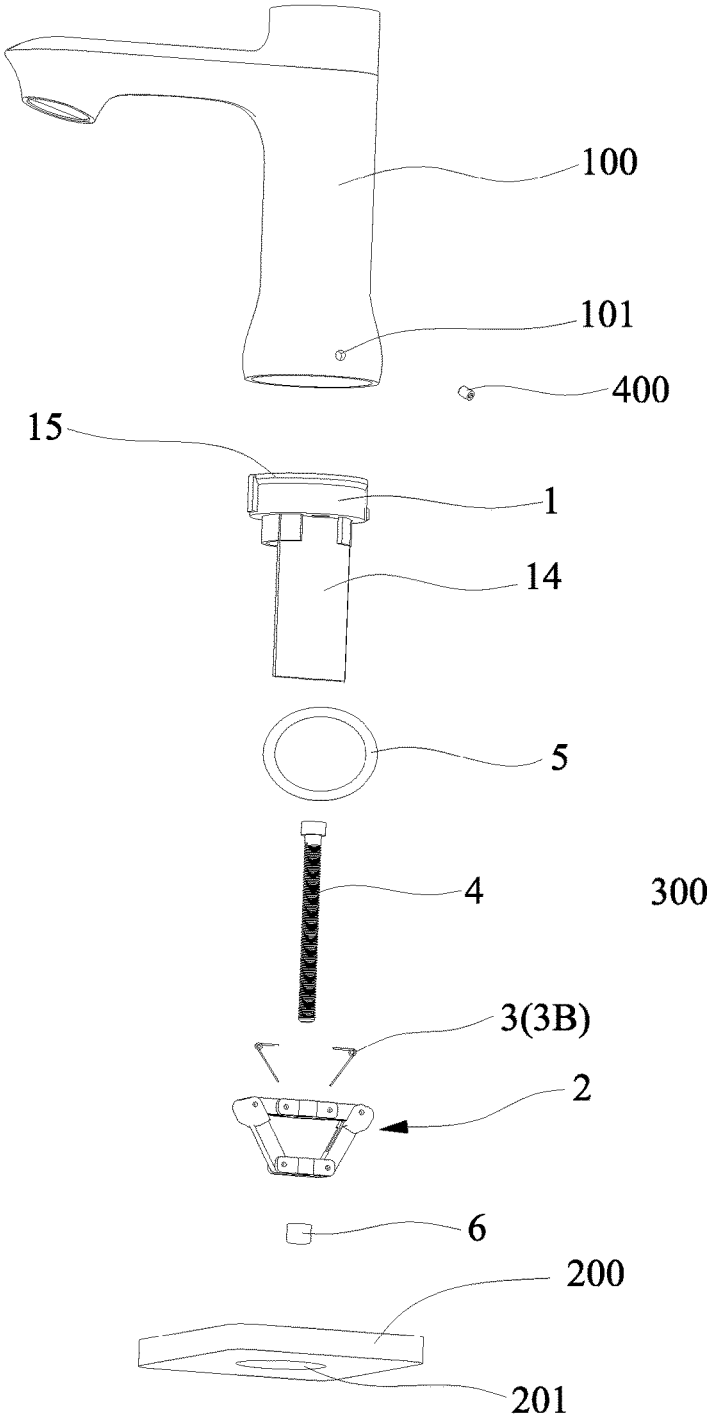
FIG. 8 is an exploded view in accordance with a second embodiment of the present invention.
Figure 9:
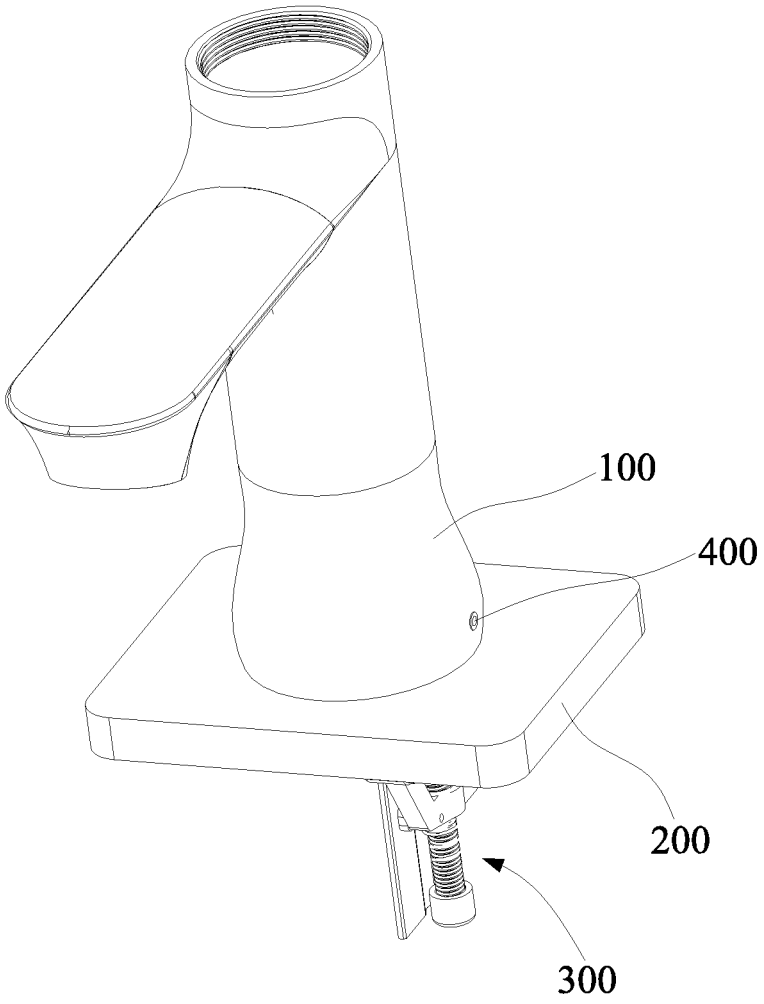
FIG. 9 is a perspective view in accordance with the second embodiment of the present invention.

As shown in FIG. 8 to FIG. 10, when the fastening device 300 is assembled, the bottom end of the bolt 4 passes through the perforation 13 of the fixing seat 1, and the linkage mechanism 2 is placed at one side of the baffle 14, opposite to the mounting passage 11, and the bottom of the bolt 4 is successively inserted through the through hole 251 of the upper connecting member 25 and the screw hole 261 of the lower connecting member 26. The nut 6 is screwed to the bottom end of the bolt 4. By the action of the elasticity of the torsion springs 3B, the first connecting rod 21, the third connecting rod 23 and the second connecting rod 22 and the fourth connecting rod 24 are unfolded by the arms 31 of the torsion springs 3B, so that the distance between the upper connecting member 25 and the lower connecting member 26 is maximized and the distance between the left and right connecting rods is minimized. In this state, the fastening device 300 can be mounted in or pulled out of the mounting hole 201 of the mounting countertop 200.

Figure 11:
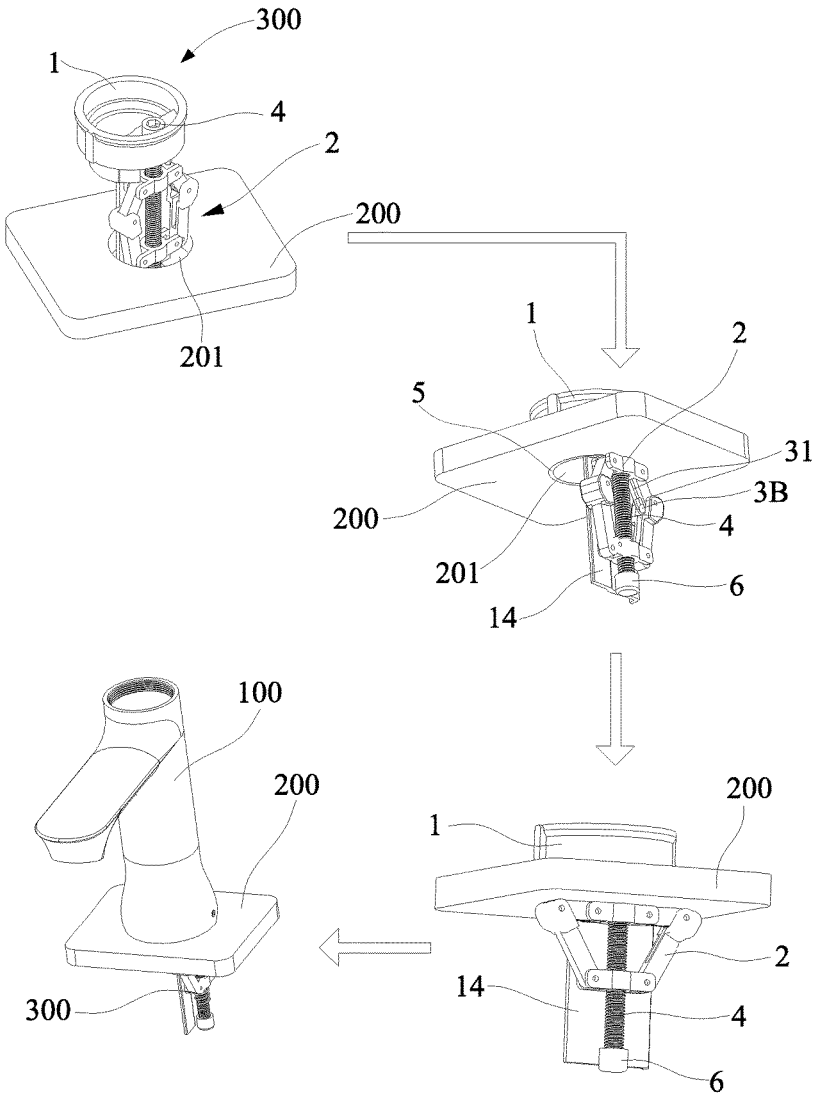
FIG. 11 is a flow chart showing the installation process of the second embodiment of the present invention.

As shown in FIG. 11, when the present invention is mounted, the linkage mechanism 2, disposed at the bottom of the fixing seat 1 and biased by torsion springs 3B and located between the upper end of the bolt 4 and the nut 6, is inserted in the mounting hole 201 of the mounting countertop 200, and then the bolt 4 is screwed. Because the lower connecting member 26 of the linkage mechanism 2 is engaged with the threads with the bolt 4, the lower connecting member 26 is rotated while the bolt 4 is rotated. But, the linkage mechanism 2 is subjected to the baffle 14 of the fixing seat 1 and cannot be rotated. When the bolt 4 is tightened, the linkage mechanism 2 is driven to move upward, so that the upper connecting member 25 of the linkage mechanism 2 abuts against the bottom surface of the mounting countertop 200 and the lower connecting member 26 is moved upward with the rotation of the bolt 4. During the process that the lower connecting member 26 is moved upward, the first connecting rod 21, the second connecting rod 22, the third connecting rod 23, and the fourth connecting rod 24 are linked to unfold outward and compress the arms 31 of the torsion springs 3B, so that the entire linkage mechanism 2 is blocked at the bottom of the mounting hole 201 until the first connecting rod 21 and the second connecting rod 22 are against the bottom surface of the mounting countertop 200. The bolt 4 is locked, and the fastening device 300 is securely engaged with the mounting countertop 200. Finally, the faucet body 100 is fitted on the fixing seat 1 of the fastening device 300 and the fastening screw 400 is inserted in the receiving hole 101 of the faucet body 100 to mate with the flange 15 of the fixing seat 1, such that the faucet body 100, the mounting countertop 200 and the fastening device 300 are joined together.

Figure 12:
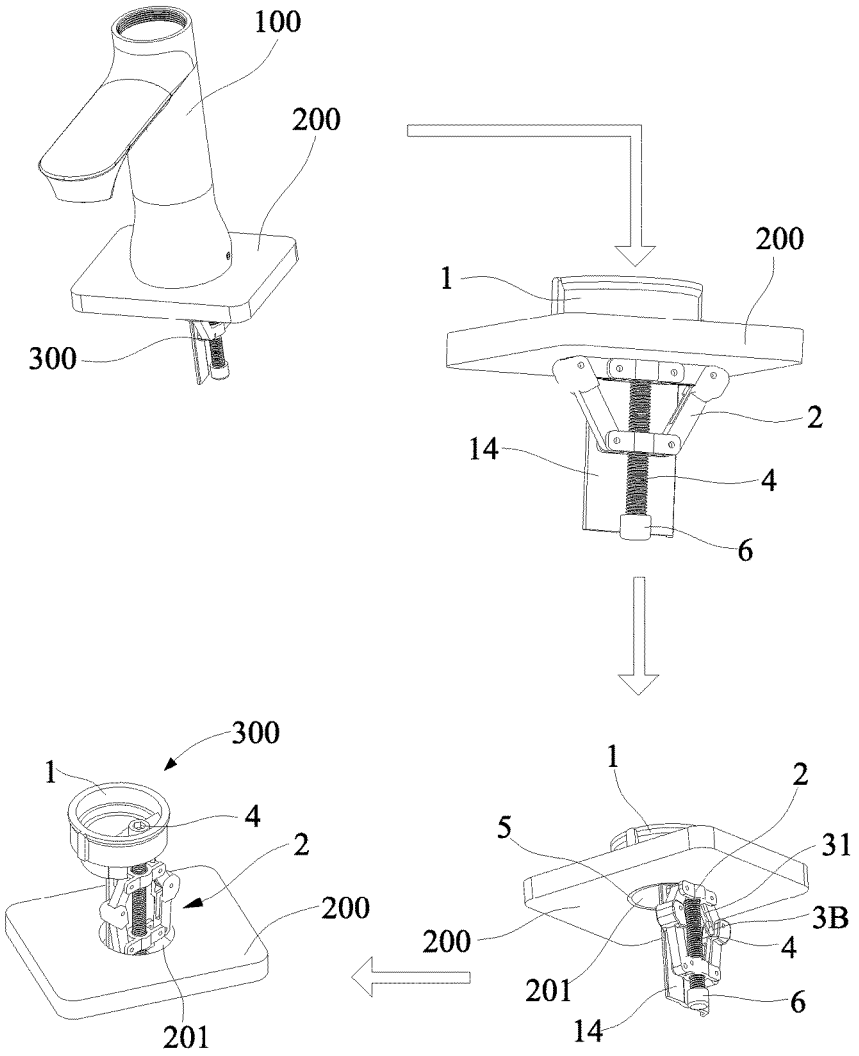
FIG. 12 is a flow chart showing the disassembly process of the second embodiment of the present invention.

As shown in FIG. 12, when the faucet is to be removed, the fastening screw 400 on the faucet body 100 is removed by a tool. The faucet body 100 is pulled out, the bolt 4 is loosened, and the bolt 4 drives the linkage mechanism 2 to move downward. The lower connecting member 26 is continuously moved toward the nut 6. The distance between the upper connecting member 25 and the lower connecting member 26 is increased by the action of the torsion springs 3B until the four connecting rods are extended to the maximum distance between the connecting member 25 and the lower connecting member 26. The lower connecting member 26 won't disengage from the bolt 4 due to the restriction of the nut 6. When the distance between the upper connecting member 25 and the lower connecting member 26 is the maximum, the lateral distance of the four connecting rods is minimized. The fastening device 300 can pass through the mounting hole 201 of the mounting countertop 200, so that the entire fastening device 300 can be pulled out from the mounting hole 201 to complete the disassembly.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A faucet mounting mechanism, comprising a faucet body and a fastening device; the fastening device including a fixing seat, a linkage mechanism, a return mechanism, and at least one bolt; the fixing seat having a mounting passage through which a pipe passes, an upper end of the fixing seat being mated with the faucet body, a lower end of the fixing seat being provided with a limit mechanism for restricting rotation of the linkage mechanism; the linkage mechanism including an upper connecting member, a lower connecting member, and a plurality of connecting rods linked by the upper connecting member and the lower connecting member, the upper connecting member having a through hole to slidably mate with the bolt, the lower connecting member having a screw hole screwed with the bolt; the return mechanism being disposed on the linkage mechanism and having an elastic force to extend the upper connecting member and the lower connecting member, by rotating the bolt on a mounting countertop, the linkage mechanism being tightly attached to a bottom of the mounting countertop under the action of the upper connecting member, the lower connecting member and the limit mechanism.

2. The faucet mounting mechanism as claimed in claim 1, wherein the fixing seat is provided with a fixing plate at one side of the mounting passage, the fixing plate has a perforation through which the bolt passes, and the limit mechanism is disposed at a bottom of the fixing plate.

3. The faucet mounting mechanism as claimed in claim 2, wherein the plurality of connecting rods include a first connecting rod, a second connecting rod, a third connecting rod and a fourth connecting rod, the first connecting rod and the second connecting rod are pivotally connected to two ends of the upper connecting member or the lower connecting member, first ends of the third connecting rod and the fourth connecting rods are pivotally connected to free ends of the first connecting rod and the second connecting rod respectively, and second ends of the third connecting rod and the fourth connecting rod are pivotally connected to the two ends of the upper connecting member or the lower connecting member.

4. The faucet mounting mechanism as claimed in claim 3, wherein the return mechanism is a return spring, and the return spring is disposed between the through hole of the upper connecting member and the screw hole of the lower connecting member.

5. The faucet mounting mechanism as claimed in claim 3, wherein the return mechanism is two torsion springs, the two torsion springs are disposed at the junction of the first connecting rod and the third connecting rod as well as the junction of the second connecting rod and the fourth connecting rod respectively, two arms of each torsion spring correspond to and hold against the first connecting rod and the third connecting rod as well as the second connecting rod and the fourth connecting rod, and adjacent ends of the first connecting rod and the third connecting rod as well as the second connecting rod and the fourth connecting rod are respectively formed with grooves for accommodating the arms of the torsion springs.

6. The faucet mounting mechanism as claimed in claim 1, wherein a bottom end of the bolt is provided with a nut for preventing the linkage mechanism from disengaging from the bolt.

7. The faucet mounting mechanism as claimed in claim 1, wherein one of the upper connecting member and the linkage mechanism has a skidproof portion, and a gasket is provided at bottom surfaces of the fixing seat and the mounting hole of the mounting countertop.

8. The faucet mounting mechanism as claimed in claim 4, wherein the junction of the first connecting rod and the third connecting rod as well as the junction of the second connecting rod and the fourth connecting rod is provided with a directional joint.

9. The faucet mounting mechanism as claimed in claim 1, wherein an outer side of the faucet body has a receiving hole, the receiving hole is mated with a fastening screw, and an outer periphery of a top end of the fixing seat of the fastening device is provided with a flange for engagement of the fastening screw.

10. The faucet mounting mechanism as claimed in claim 1, wherein the fixing seat includes a limit mounting ring to mate with the mounting hole of the mounting countertop, and the limit mounting ring is eccentrically disposed relative to the fixing seat.

* * * * *